US011738582B2

(12) United States Patent
Ando

(10) Patent No.: US 11,738,582 B2
(45) Date of Patent: Aug. 29, 2023

(54) PRINTER AND METHOD OF MANUFACTURING PRINTER

(71) Applicant: Seiko Instruments Inc., Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 17/746,056

(22) Filed: May 17, 2022

(65) Prior Publication Data

US 2022/0371345 A1 Nov. 24, 2022

(30) Foreign Application Priority Data

May 21, 2021 (JP) ..... 2021-086132

(51) Int. Cl.

| | |
|---|---|
| ***B41J 3/36*** | (2006.01) |
| ***B41J 3/407*** | (2006.01) |
| ***B41J 29/02*** | (2006.01) |
| *B41J 2/32* | (2006.01) |

(52) U.S. Cl.

CPC ..... *B41J 29/02* (2013.01); *B41J 3/36* (2013.01); *B41J 2/32* (2013.01)

(58) Field of Classification Search

CPC ..... B41J 29/02; B41J 3/36; B41J 2/32; B41J 11/0095; B41J 3/4075

See application file for complete search history.

(56) References Cited

U.S. PATENT DOCUMENTS

2007/0002402 A1 1/2007 Ochiai et al.
2013/0314721 A1* 11/2013 Colonel ..... B41J 11/0025 358/1.1
2017/0275042 A1* 9/2017 Hirose ..... B65C 9/1811
2017/0308013 A1* 10/2017 Buthrath ..... B41J 15/042

FOREIGN PATENT DOCUMENTS

JP 2011-131569 A 7/2011

OTHER PUBLICATIONS

Extended European Search Report in Europe Application No. 22173902.2, dated Oct. 18, 2022, 5 pages.

* cited by examiner

*Primary Examiner* — Scott A Richmond
(74) *Attorney, Agent, or Firm* — Crowell & Moring LLP

(57) ABSTRACT

A printer includes: a mechanism frame configured to receive a recording medium including a liner having a large length, and a plurality of labels temporarily bonded on the liner; a support member supported on the mechanism frame through intermediation of a support shaft; a head which is mounted to the support member, and is configured to perform printing on at least one of the plurality of labels; and a transmissive sensor which is arranged between the head and the support shaft, and is configured to detect the at least one of the plurality of labels, wherein the mechanism frame includes: a frame portion provided between the head and the support shaft at a distance from the support shaft; and a recessed portion which is formed in the frame portion, and is configured to increase the distance so as to allow the sensor to pass through a space having the distance.

5 Claims, 10 Drawing Sheets

PRINTER AND METHOD OF MANUFACTURING PRINTER

RELATED APPLICATIONS

This application claims priority to Japanese Patent Application No. 2021-086132, filed on May 21, 2021, the entire content of which is incorporated herein by reference.

BACKGROUND OF THE INVENTION

1. Field of the Invention

The present invention relates to a printer and a method of manufacturing a printer.

2. Description of the Related Art

Hitherto, the following printer has been known. In the printer, there is received a recording sheet (recording medium) that is wound into a roll shape, which includes a liner having a large length and a plurality of labels temporarily bonded on the liner at predetermined intervals. The printer performs printing on the label temporarily bonded on the liner. This printer includes a transmissive optical sensor for detecting a gap between the labels temporarily bonded on the liner. In order to increase, for example, positioning accuracy of printing performed on the label by a thermal head (hereinafter simply referred to as a head), a light emitting element and a light receiving element of the transmissive sensor are arranged in the vicinity of the head.

According to this printer, for example, under a state in which a longitudinal edge of the recording sheet wound into a roll shape is sandwiched between the head and a platen roller, the platen roller is rotated. Through rotation of the platen roller, the recording sheet sandwiched between the head and the platen roller is conveyed.

Under this state, light is radiated from the light emitting element of the transmissive sensor to the light receiving element, and the radiated light is transmitted through the recording sheet. Through detection of intensity of the transmitted light by the light receiving element, a position of the label temporarily bonded on the recording sheet is detected. Based on information of the detected position of the label, the head performs printing on each label.

Here, in the printer described above, the light emitting element and the light receiving element of the transmissive sensor are arranged in the vicinity of the head. Further, the head is supported on, for example, a head support member, and the head support member is supported on a support shaft. Moreover, the transmissive sensor is arranged between the head and a head shaft. The support shaft is supported on a mechanism frame (that is, a casing).

Thus, at the time of assembly of the transmissive sensor, it is required that the transmissive sensor be passed through a gap between the support shaft and the mechanism frame. There may be a risk in that, for example, a surface of the transmissive sensor is brought into contact with the mechanism frame, resulting in damage of the surface of the transmissive sensor. In order to assemble the transmissive sensor while preventing contact of the surface of the transmissive sensor with the mechanism frame, it is required that the support shaft be disassembled from the mechanism frame. In terms of, for example, ease of assembly, improvement has been demanded.

Accordingly, in this technical field, there have been demands for a printer and a method of manufacturing a printer, which are capable of improving ease of assembly.

SUMMARY OF THE INVENTION

According to one embodiment of the present invention, there is provided a printer including: a mechanism frame configured to receive a recording medium including a liner having a large length, and a plurality of labels temporarily bonded on the liner; a support member supported on the mechanism frame through intermediation of a support shaft; a head which is mounted to the support member, and is configured to perform printing on at least one of the plurality of labels; and a transmissive sensor which is arranged between the head and the support shaft, and is configured to detect the at least one of the plurality of labels, wherein the mechanism frame includes: a frame portion provided between the head and the support shaft at a distance from the support shaft; and a recessed portion which is formed in the frame portion, and is configured to increase the distance so as to allow the transmissive sensor to pass through a space having the distance.

In the above-mentioned printing system according to the one embodiment of the present invention, the printer further includes: a sensor holder which includes a snap-fit portion that is elastically deformable and is locked to the mechanism frame, and is configured to fix the transmissive sensor to the mechanism frame through locking of the snap-fit portion to the mechanism frame.

In the above-mentioned printing system according to the one embodiment of the present invention, the recessed portion is formed into a curved surface larger than a distal-end curved surface of the transmissive sensor.

In the above-mentioned printing system according to the one embodiment of the present invention, the transmissive sensor includes: a light emitting element supported on the mechanism frame; and a light receiving element supported on the cover so as to face the light emitting element, and wherein the light emitting element is passed through the space having the distance increased owing to the presence of the recessed portion, and then is arranged between the head and the support shaft.

According to one embodiment of the present invention, there is provided a method of manufacturing a printer, the printer including: a mechanism frame configured to receive a recording medium including a liner having a large length, and a plurality of labels temporarily bonded on the liner; a support member supported on the mechanism frame through intermediation of a support shaft; a head which is mounted to the support member, and is configured to perform printing on at least one of the plurality of labels; a transmissive sensor which is arranged between the head and the support shaft, and is configured to detect the at least one of the plurality of labels; and a sensor holder including a snap-fit portion that is elastically deformed and lockable to the mechanism frame in order to fix the transmissive sensor to the mechanism frame, the mechanism frame including: a frame portion provided between the head and the support shaft at a distance from the support shaft; and a recessed portion which is formed in the frame portion, and is configured to increase the distance so as to allow the transmissive sensor to pass through a space having the distance, the method including: a sensor inserting step of passing the transmissive sensor through the space having the distance increased owing to the presence of the recessed portion, and then inserting the transmissive sensor between the head and the support shaft; a sensor temporary-fixing step of temporarily fixing the transmissive sensor, which is inserted between the head and the support shaft, to the mechanism frame; a sensor holder inserting step of inserting the sensor holder into the space having the distance; and a sensor fixing step of elastically deforming the snap-fit portion of the sensor holder, and locking the snap-fit portion to the mechanism frame, thereby fixing the temporarily-fixed transmissive sensor to the mechanism frame by the sensor holder.

DETAILED DESCRIPTION OF THE PREFERRED EMBODIMENTS

Figure 1:
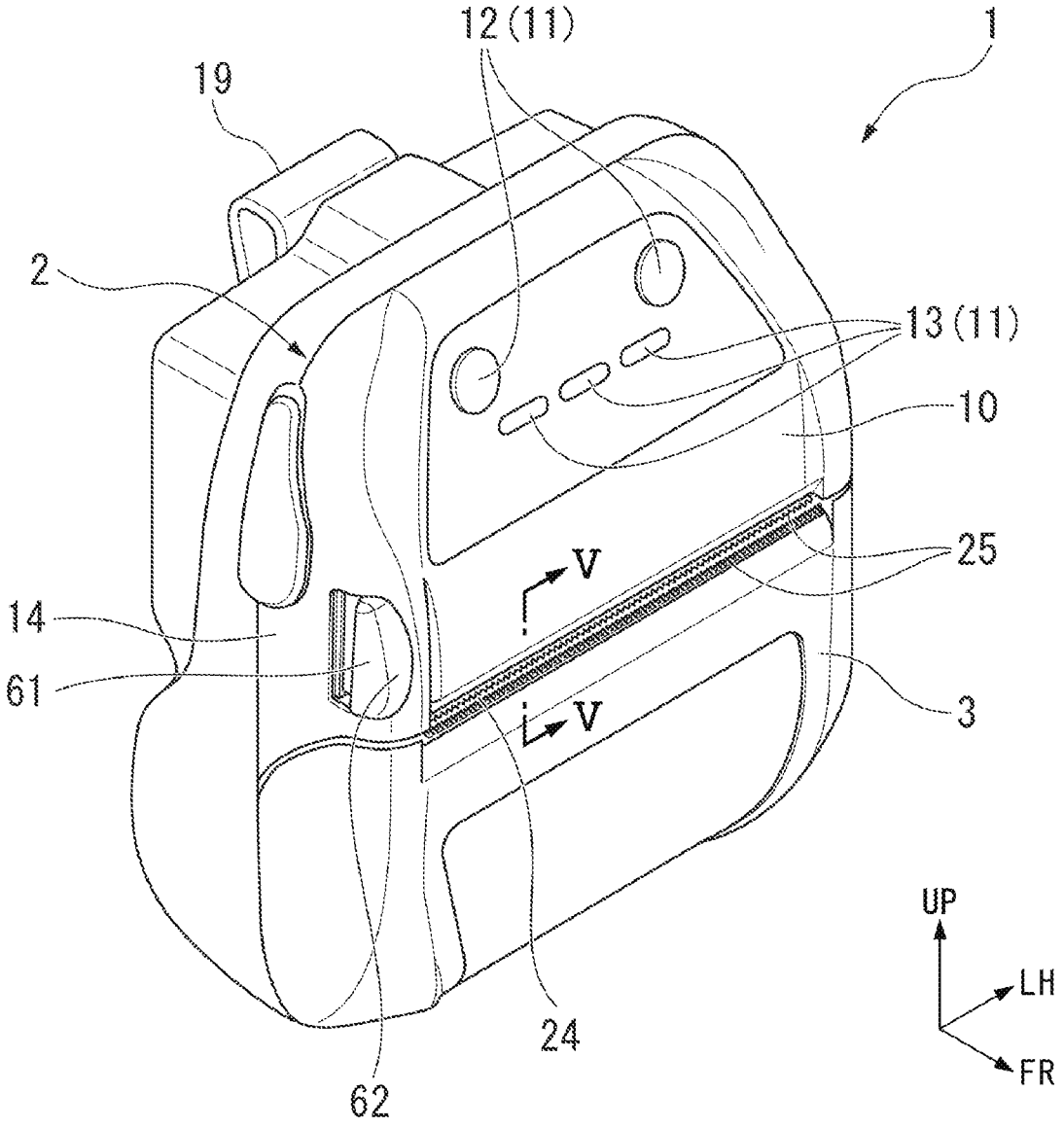
FIG. 1 is a perspective view for illustrating a thermal printer according to an embodiment of the present invention in a state in which a cover is closed at a closed position.

Now, an embodiment of the present invention is described with reference to the drawings. In the following embodiment, as a printer, there is exemplified a portable thermal printer capable of being carried by a user. However, the printer is not limited to the portable thermal printer. In the drawings to be referred to in the following description, in order to illustrate each component with a recognizable size, a contraction scale of each component is changed as appropriate. In the drawings, FR, LH, and UP represent a front side, a left side, and an upper side of the portable printer, respectively. In the following embodiment, a posture of the thermal printer assumed during carrying of the thermal printer, which has front-and-rear, up-and-down, and right-and-left directions as illustrated in FIG. 1, is referred to as "an assumed carriage posture", and description is made of the thermal printer in the assumed carriage posture.

Figure 2:
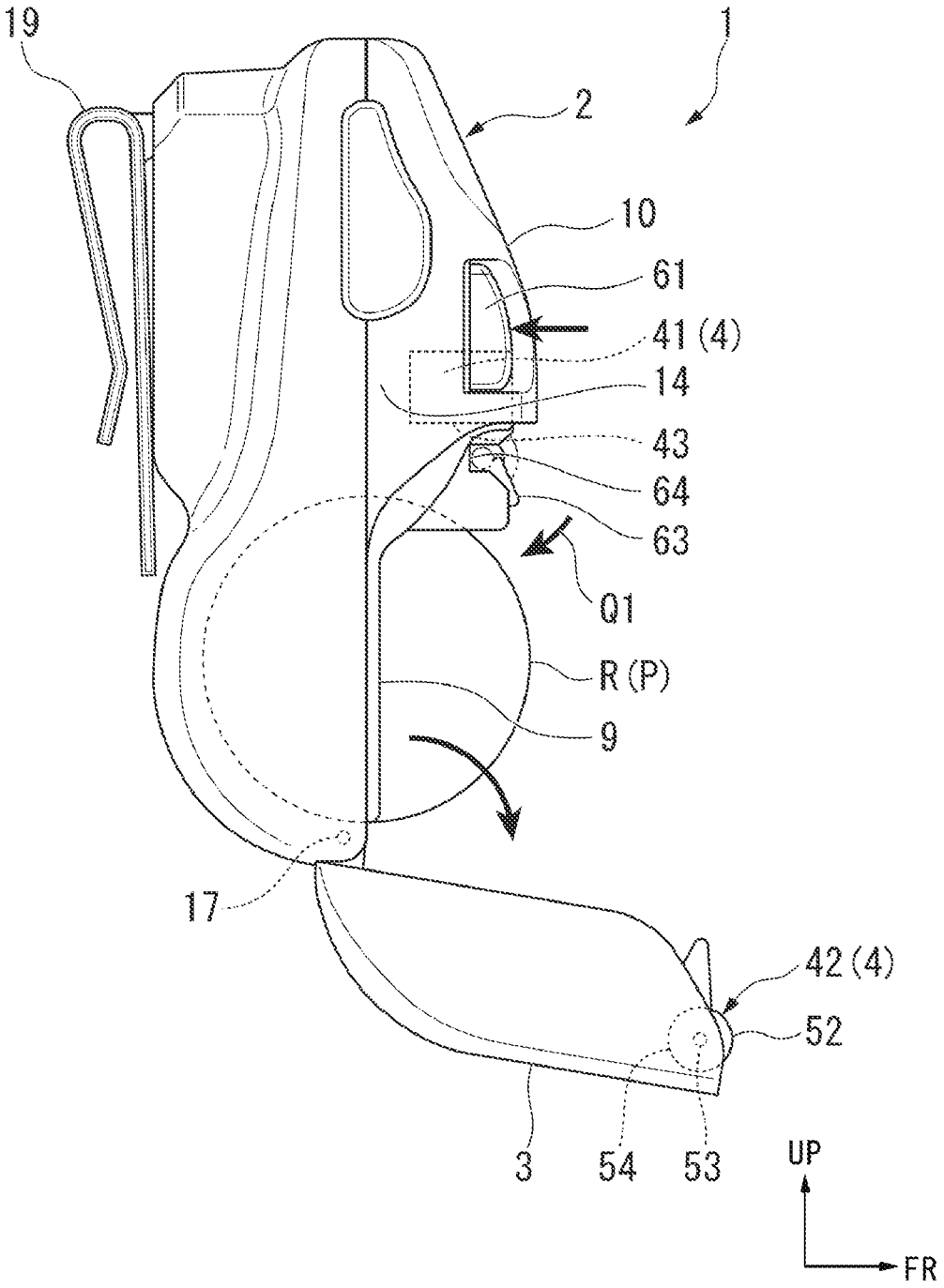
FIG. 2 is a side view for illustrating the thermal printer according to the embodiment in a state in which the cover is opened at an opened position.
Figure 5:
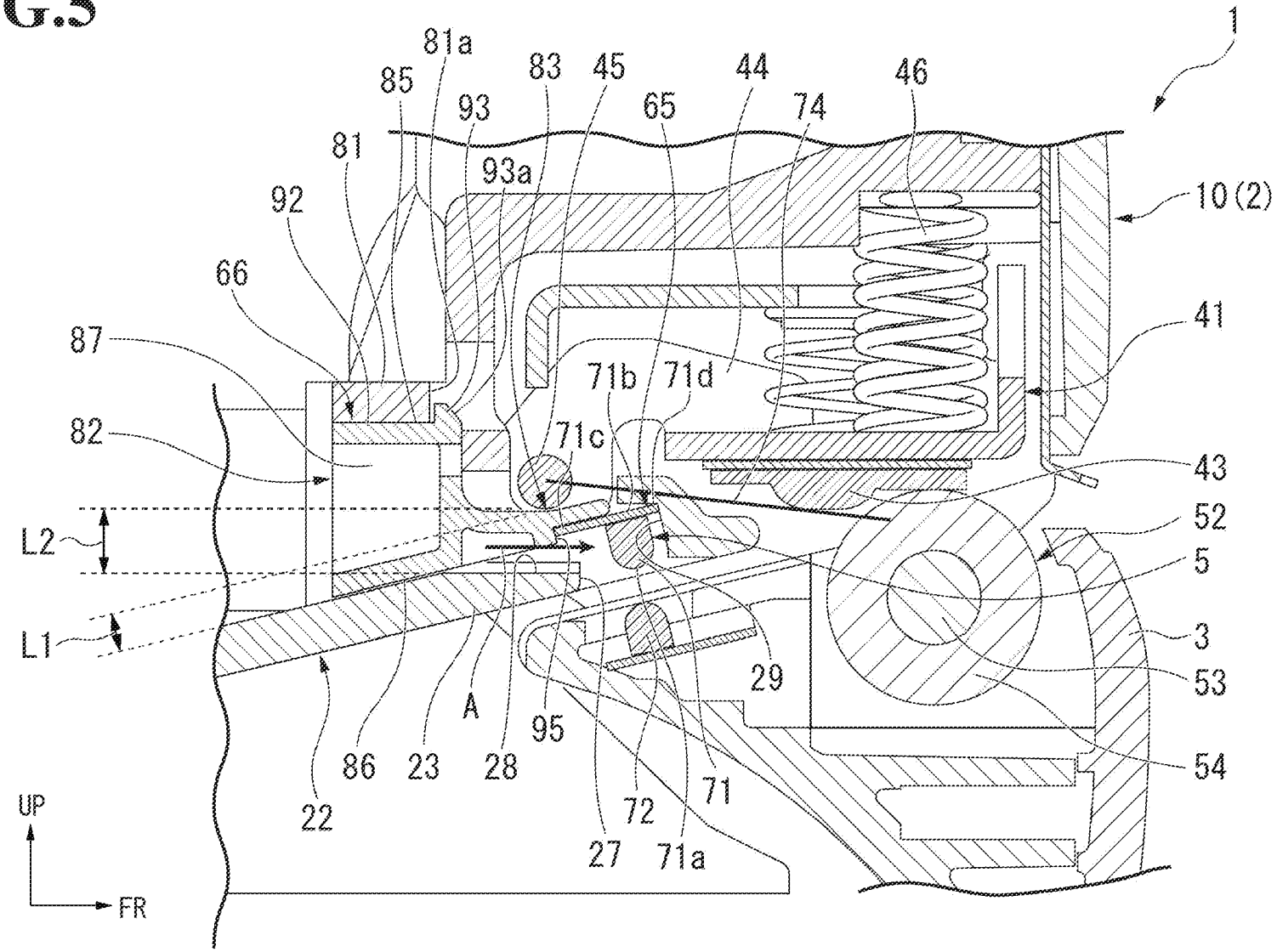
FIG. 5 is a sectional view for illustrating the thermal printer taken along the line V-V of FIG. 1.

As illustrated in FIG. 1 and FIG. 2, a thermal printer 1 includes a casing (mechanism frame) 2, a cover (paper cover) 3, a printing unit 4, and a transmissive sensor unit 5 (see FIG. 5). The thermal printer 1 performs printing on each of a plurality of labels 32 (see FIG. 3) of a recording sheet P being a recording medium, and delivers the printed label 32 (that is, a piece of the recording sheet P) through a delivery port 24.

For example, the casing 2 is made of a resin material such as polycarbonate, or a metal material. An upper portion of the casing 2 is formed into a rectangular parallelepiped shape to include a front wall 10 and side walls 14. A lower portion of the casing 2 is formed into a box-like shape to have an opening portion 9 (also see FIG. 3) opens forward.

An operation unit 11 is provided in an upper portion of the front wall 10 of the casing 2. The operation unit 11 is configured to perform various operations on the thermal printer 1. The operation unit 11 includes various function switches 12 such as a power switch and a FEED switch, and various lamps 13 such as a POWER lamp configured to inform ON/OFF information of the power switch, and an ERROR lamp configured to inform, for example, an error of the thermal printer 1.

Figure 3:
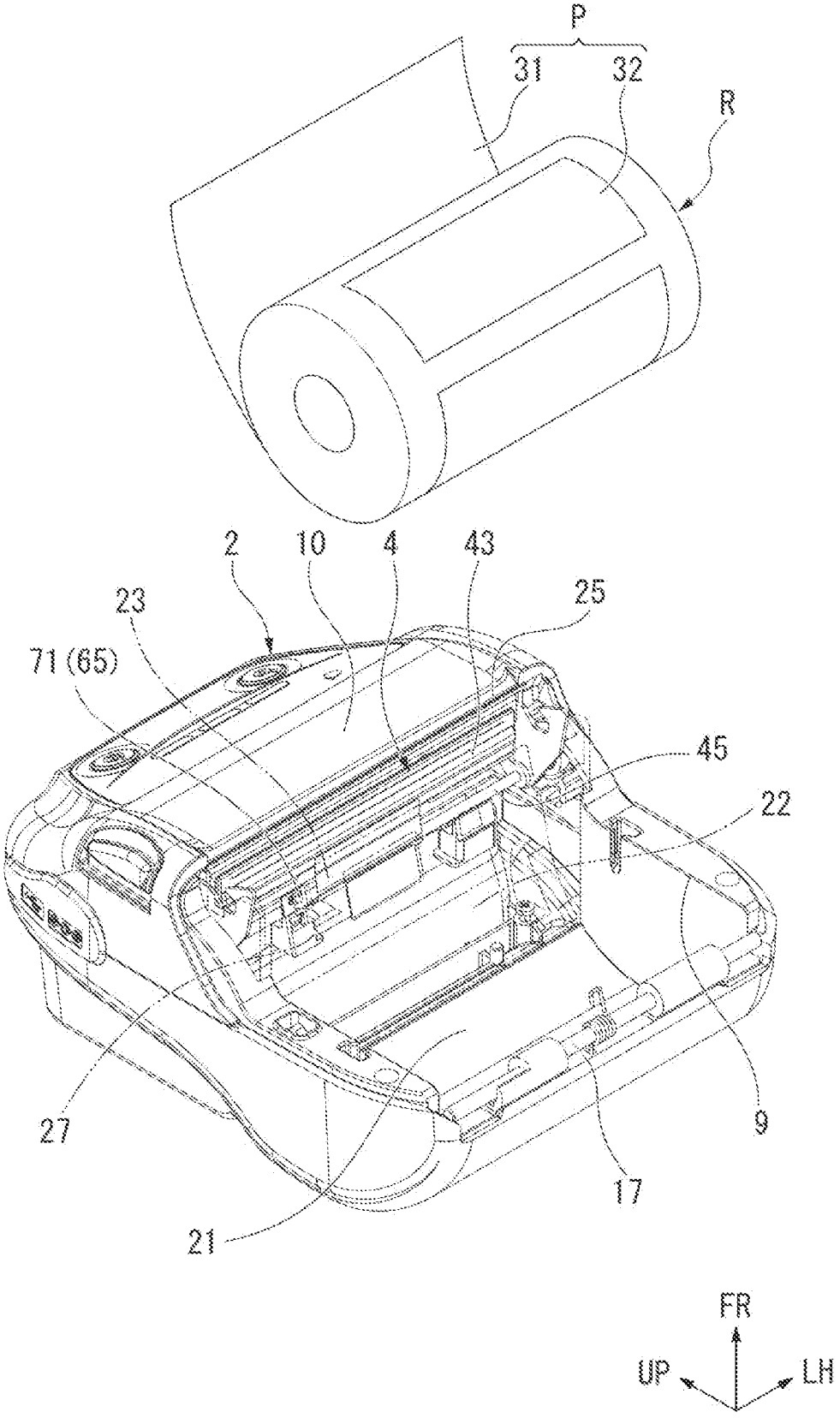
FIG. 3 is a perspective view for illustrating the thermal printer according to the embodiment from which the cover is removed.
Figure 4:
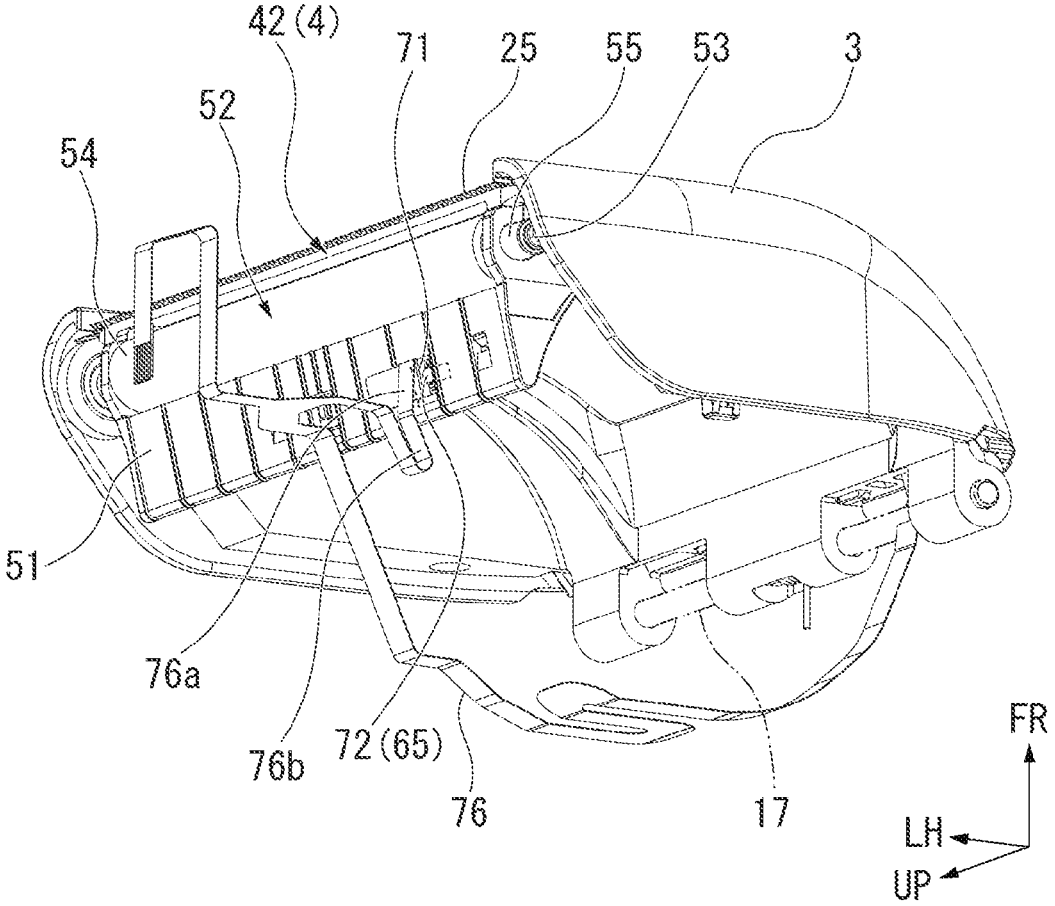
FIG. 4 is a perspective view for illustrating the cover of the thermal printer according to the embodiment.

As illustrated in FIG. 3 and FIG. 4, a roll sheet receiving portion 21 is defined in the lower portion of the casing 2. A roll sheet R is received in the roll sheet receiving portion 21 through the opening portion 9. The roll sheet receiving portion 21 includes a guide plate 22 configured to receive the roll sheet R. The guide plate 22 defines a sheet receiving portion together with an inner surface of the cover 3. The roll sheet R is held in the sheet receiving portion. The guide plate 22 has an arc-shaped cross section when seen from the right-and-left direction. The guide plate 22 holds the roll sheet R under a state in which an outer peripheral surface of the roll sheet R is held in contact with an arc-shaped inner peripheral surface of the guide plate 22. The guide plate 22 is configured to guide the recording sheet P, which is drawn out from the roll sheet R, to the printing unit 4. The guide plate 22 includes a guide distal end portion (frame portion) 23 that is substantially opposed to a space between a thermal head 43 and a support shaft 45 in the front-and-rear direction to be described later. The guide distal end portion 23 is described later in detail.

In the embodiment, the recording sheet P is a label continuous body including a liner 31 having a large length, and a large number of labels (for example, heat-sensitive labels) 32 temporarily bonded on a surface (label bonding surface) of the liner 31 at predetermined intervals. A surface (print surface) of the label 32 is coated with a heat-sensitive color-developing layer that develops color when reaching a predetermined temperature range. The recording sheet P is received in the roll sheet receiving portion 21 of the casing 2 under a state in which the recording sheet P is wound into a roll shape.

The cover 3 forms a lower front surface of the thermal printer 1. For example, the cover 3 is made of a resin material such as polycarbonate. The cover 3 is a covering portion (paper cover) configured to open and close the opening portion 9 of the casing 2. The cover 3 is supported at a lower end portion thereof on a lower end portion of the casing 2 through intermediation of a hinge shaft 17 so as to be pivotable.

An upper end portion of the cover 3 is lockable to the casing 2 through intermediation of a platen unit 42 to be described later. A platen roller 52 to be described later is supported on the cover 3 so as to be freely rotatable. At a closed position of the cover 3, a gap defined between an upper edge of the cover 3 and a lower edge of the front wall 10 of the casing 2 forms the delivery port 24 (see FIG. 1) through which the recording sheet P subjected to printing by the printing unit 4 is delivered.

As illustrated in FIG. 1 and FIG. 3, cutting blades 25 are provided at opening edges of the delivery port 24. The cutting blades 25 are configured to cut the recording sheet P delivered through the delivery port 24. The cutting blades 25 are integrally formed at the lower edge of the front wall 10 of the casing 2 (or an upper opening edge portion among the opening edges), and the upper edge of the cover 3 (see FIG. 4), respectively. For example, the liner 31 of the recording sheet P is cut by pulling down the recording sheet P toward the cutting blades 25.

As illustrated in FIG. 1 and FIG. 2, a hook 19 is provided on a back-side upper portion of the casing 2. For example, a strap or a belt is mountable to the hook 19. For example, when a user carries the thermal printer 1, it is assumed that the user often carries the thermal printer 1 under a state in which a strap slung across a shoulder or a waist belt is mounted to the hook 19. Accordingly, the state of the thermal printer 1 having the front-and-rear, up-and-down, and right-and-left directions as illustrated in FIG. 1 corresponds to an assumed carriage state of the thermal printer 1.

As illustrated in FIG. 2, the printing unit 4 is received in the casing 2 and the cover 3. The printing unit 4 includes a head unit 41 and the platen unit 42. The printing unit 4 performs printing on the label 32 (see FIG. 3), which is a portion of the recording sheet P drawn out from the roll sheet R.

Figure 6:
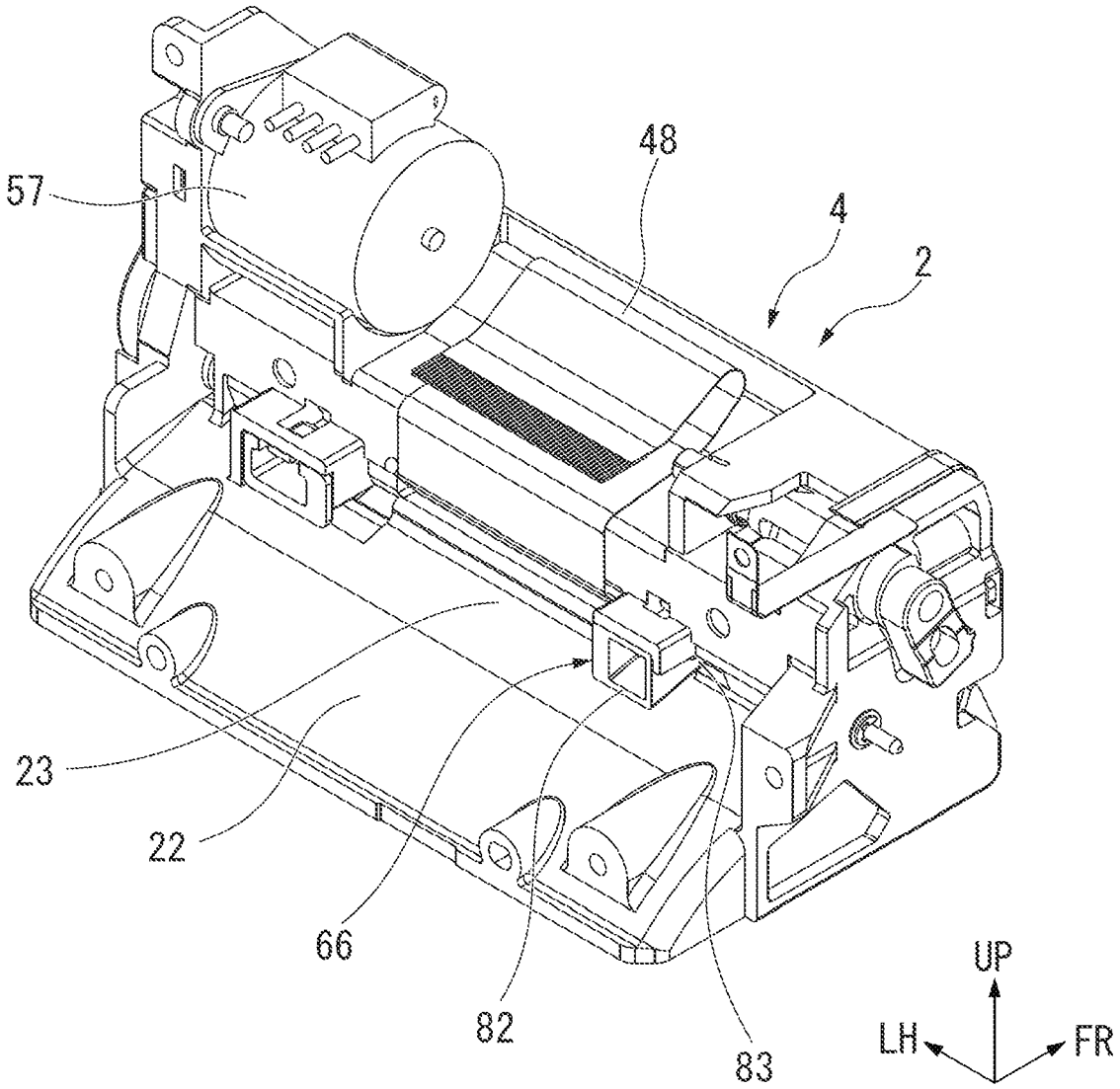
FIG. 6 is a perspective view for illustrating a printing unit and other components of the thermal printer according to the embodiment when seen from an upper rear side of the thermal printer.

As illustrated in FIG. 3, FIG. 5, and FIG. 6, the head unit 41 is provided on a lower end portion of the front wall 10 of the casing 2. The head unit 41 includes the thermal head (head) 43 including a plurality of heating elements. The thermal head 43 is supported on the casing 2 through intermediation of, for example, a head support member (support member) 44. That is, the head support member 44 is supported at a rear end portion thereof on the lower end portion of the casing 2 through intermediation of the support shaft 45 so as to be pivotable. That is, the thermal head 43 is supported on the casing 2 through intermediation of the head support member 44 and the support shaft 45 so as to be pivotable.

The head support member 44 is a member configured to keep the cover 3 in a closed state, and is arranged so as to be opposed to the platen roller 52 to be described later under a state in which the cover 3 is closed. The head support member 44 is always urged by an elastic force of a coil spring 46 in a direction of coming close to the platen roller 52. The thermal head 43 is mounted to an upper end portion of the head support member 44 by, for example, bonding.

The thermal head 43 is connected to, for example, a control unit (not shown) through a flexible board 48 (illustrated in FIG. 6). In the thermal head 43, a driver IC (not shown) installed on the thermal head 43 controls generation of heat of the heating elements based on a signal from the control unit. Then, when the label 32 passes through the heating elements of the thermal head 43, the heating elements perform printing on the label 32.

As illustrated in FIG. 4 and FIG. 5, the platen unit 42 is provided at the upper end portion (distal end portion) of the cover 3. The platen unit 42 is combined with the head unit 41 so as to be attachable and detachable through opening and closing operation of the cover 3. The platen unit 42 includes a platen frame 51 and the platen roller 52. The platen frame 51 is mounted to the cover 3. The platen roller 52 is supported on the platen frame 51 so as to be rotatable.

Under a state in which the cover 3 is closed, the platen roller 52 is arranged so as to be opposed to the thermal head 43. The platen roller 52 is configured to convey the recording sheet P (see FIG. 3) while sandwiching the recording sheet P together with the thermal head 43.

The platen roller 52 includes a platen shaft 53 and a roller main body 54. The platen shaft 53 extends along the right-and-left direction. The roller main body 54 is made of, for example, rubber that is externally fitted to the platen shaft 53. Bearings 55 (only a bearing 55 on a right side is illustrated) are externally fitted to both end portions of the platen shaft 53, respectively. The bearings 55 are configured to support the platen shaft 53 in a rotatable manner. The platen roller 52 is supported on the platen frame 51 through intermediation of the bearings 55 so as to be rotatable.

For example, a platen gear (not shown) is mounted to a left end portion of the platen shaft 53. The head unit 41 includes a train mechanism and a motor 57 (see FIG. 6). The train mechanism is meshed with the platen gear (not shown). The motor 57 is connected to the train mechanism. When the platen unit 42 and the head unit 41 are combined with each other, the platen gear is meshed with the train mechanism provided on the head unit 41 side, thereby transmitting a rotational drive force of the motor 57 to the platen roller 52. When the rotational drive force of the motor 57 is transmitted to the platen roller 52, the platen roller 52 is rotated. Further, when the platen unit 42 and the head unit 41 are combined with each other, the thermal head 43 of the head unit 41 is brought into press-contact with an outer peripheral surface of the platen roller 52. Under this state, the platen roller 52 is rotated, thereby conveying the recording sheet P (see FIG. 3) sandwiched between the platen roller 52 and the thermal head 43.

As illustrated in FIG. 1 and FIG. 2, a button 61 is provided in a boundary portion between the front wall 10 and the side wall 14 of the casing 2. The button 61 includes a push surface 62 on a front surface thereof. The button 61 is an operation portion configured to perform operation of separating the thermal head 43 and the platen roller 52 from each other. The button 61 is an operation portion configured to release locking between the casing 2 and the cover 3, to thereby open the opening portion 9 of the casing 2 (see FIG. 3).

For example, when the button 61 is pushed, a lock arm 63 pivots in a direction indicated by the arrow Q1 of FIG. 2 against an urging member. Then, the lock arm 63 is disengaged from the bearing 55 (see FIG. 4) of the platen shaft 53 so that the platen roller 52 is disengaged from a roller insertion groove 64. Thus, the cover 3 can be opened.

For example, when the button 61 is pushed as indicated by the arrow of FIG. 2 (pushed toward the rear side in the assumed carriage posture), the locking between the casing 2 and the cover 3 is released. Thus, the cover 3 pivots from the closed position illustrated in FIG. 1 to the opened position illustrated in FIG. 2 as indicated by the arrow of FIG. 2.

As illustrated in FIG. 3, FIG. 5, and FIG. 6, the transmissive sensor unit 5 includes a transmissive sensor 65 and a sensor holder 66. The transmissive sensor 65 detects each of the large number of labels 32 temporarily bonded on the liner 31 of the recording sheet P. The transmissive sensor 65 is, for example, a transmissive optical sensor, and is arranged between the thermal head 43 and the support shaft 45 in the front-and-rear direction (that is, in the vicinity of the thermal head 43). In the thermal printer 1, in general, the cover 3 is limited in size in a direction of feeding the recording sheet P. Thus, it is required that the transmissive sensor 65 arranged in the casing 2 be arranged in the vicinity of the thermal head 43.

The transmissive sensor 65 includes a light emitting element 71 and a light receiving element 72. The light emitting element 71 is supported on the casing 2. The light emitting element 71 is arranged between the thermal head 43 and the support shaft 45 in the front-and-rear direction. Further, the guide plate 22 of the casing 2 includes the guide distal end portion 23 that is substantially opposed to the space between the thermal head 43 and the support shaft 45. The guide distal end portion 23 is located below a straight line 74 extending from the support shaft 45 toward the thermal head 43. That is, the guide distal end portion 23 is provided between the thermal head 43 and the support shaft 45 in the front-and-rear direction and below the support shaft 45 at a first distance (spacing or gap) L1 from the support shaft 45.

The guide distal end portion 23 is formed into an upward inclined shape so as to be closer to the thermal head 43 as extending from the support shaft 45 side toward the thermal head 43 located on the front side. The guide distal end portion 23 is inclined upward so as to be closer to the thermal head 43, and thus the guide distal end portion 23 guides the recording sheet P toward the thermal head 43. The guide distal end portion 23 includes an opening portion 27 formed in a portion opposed to the light emitting element 71. The opening portion 27 is located more on the front side than the support shaft 45.

Here, the guide distal end portion 23 is inclined upward so as to be closer to the thermal head 43 so that the first distance L1 between the support shaft 45 and the guide distal end portion 23 is relatively small. Thus, for example, when the light emitting element 71 is assembled toward the front side from the rear side of the support shaft 45 through a space having the first distance L1 between the support shaft 45 and the guide distal end portion 23 so as to be opposed to the opening portion 27, there is a risk in that a distal end portion of the light emitting element 71 interferes with the guide distal end portion 23. Accordingly, in the embodiment, a recessed portion (notch) 28 is formed in a portion (surface) of the guide distal end portion 23 opposed to the support shaft 45.

Figure 7:
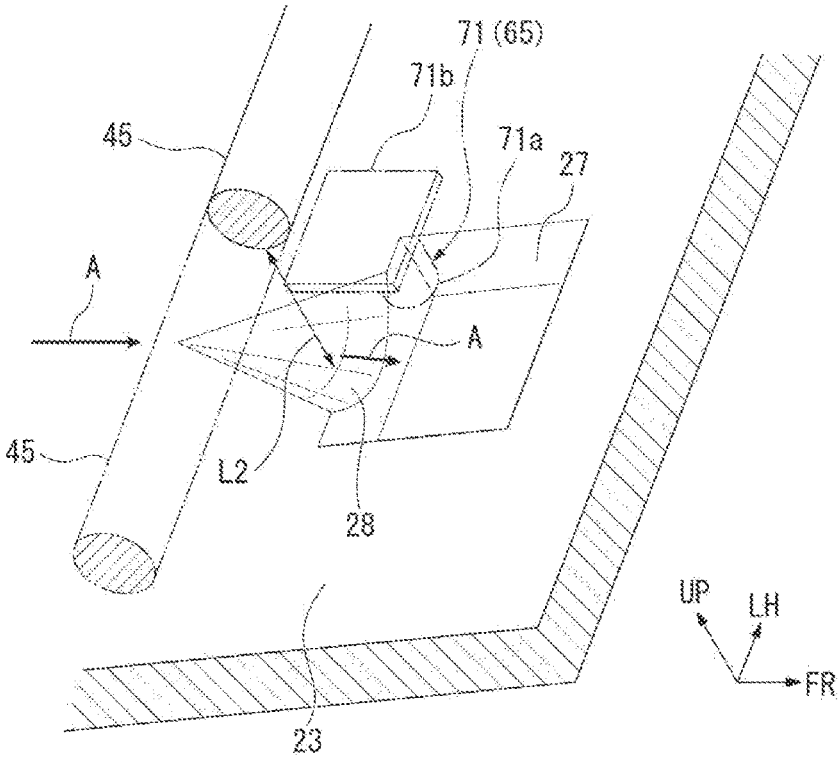
FIG. 7 is a perspective view for illustrating a second distance between a support shaft and a recessed portion in the thermal printer according to the embodiment.
Figure 8:
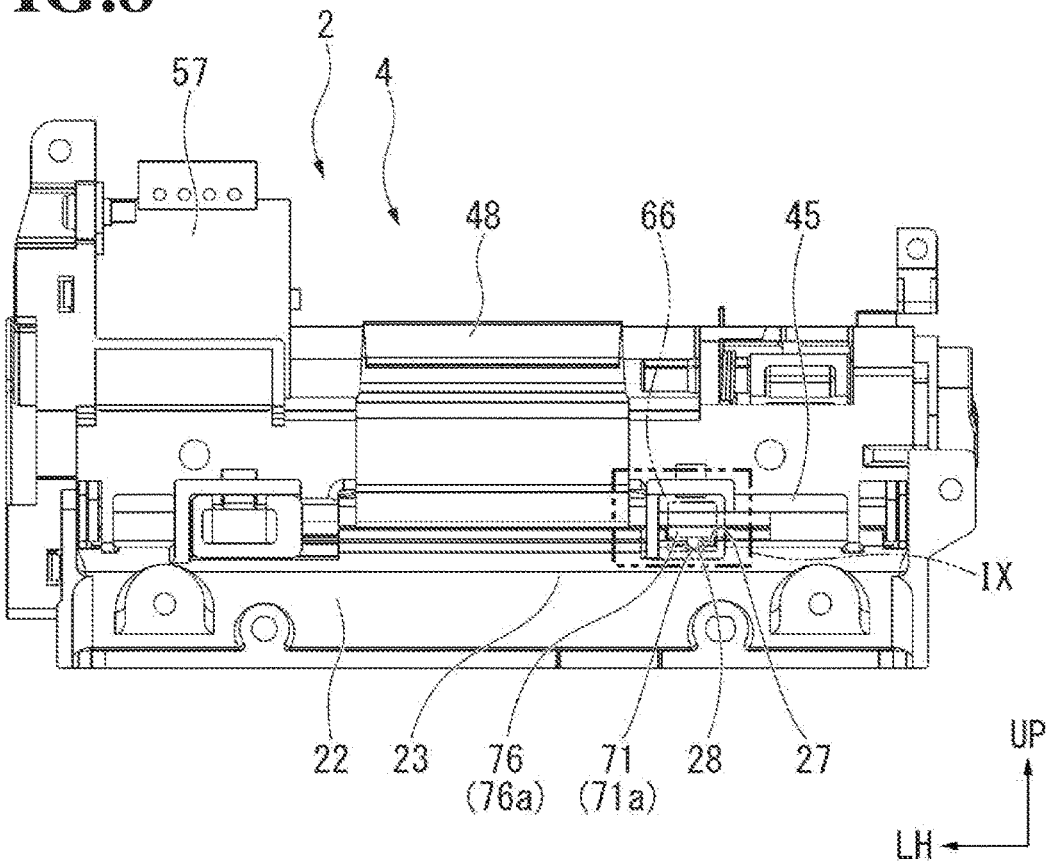
FIG. 8 is a back view for illustrating the printing unit and other components of FIG. 6 when seen from a rear side of the thermal printer.

As illustrated in FIG. 5, FIG. 7, and FIG. 8, the recessed portion 28 is formed in the guide distal end portion 23 so that a second distance (spacing or gap) L2 between the support shaft 45 and the guide distal end portion 23 (specifically, the recessed portion 28) is increased. That is, the second distance L2 between the support shaft 45 and the recessed portion 28 is increased so as to allow passage of the light emitting element 71. Accordingly, at the time of assembly of the light emitting element 71, without involving interference of a distal end portion 71*a* of the light emitting element 71 with the recessed portion 28 (that is, the guide distal end portion 23), the light emitting element 71 can be passed through a space having the second distance L2 as indicated by the arrow A of FIG. 7.

With this configuration, the light emitting element 71 can be arranged at an assembly position opposed to the opening portion 27 (that is, a position between the thermal head 43 and the support shaft 45). Thus, without disassembling the support shaft 45 from the casing 2, the light emitting element 71 can be assembled to the assembly position between the thermal head 43 and the support shaft 45. Accordingly, ease of assembly of the light emitting element 71 (that is, the transmissive sensor 65) can be improved.

Here, as illustrated in FIG. 4 and FIG. 5, the light emitting element 71 is connected to a sensor flexible board 76, and thus is also connected to the light receiving element 72 (to be described later) through the sensor flexible board 76. The sensor flexible board 76 is a board having flexibility. For example, the light emitting element 71 is connected to a distal end portion 76*a* of the sensor flexible board 76, and a portion 76*b* of the sensor flexible board 76, which is close to the light emitting element 71 to some extent, is bent into a U-shape. The portion bent into a U-shape is hereinafter also referred to as "U-shaped bent portion 76*b*".

Under a state in which the light emitting element 71 is arranged at the assembly position, elastic forces are generated in, for example, the distal end portion 76*a* and the U-shaped bent portion 76*b* of the sensor flexible board 76. Thus, under a state in which the light emitting element 71 is arranged at the assembly position, by the elastic forces of the distal end portion 76*a*, the U-shaped bent portion 76*b*, and other portions, the light emitting element 71 is temporarily fixed to the assembly position in the casing 2. The elastic forces of the distal end portion 76*a*, the U-shaped bent portion 76*b*, and other portions are described later in detail. The light emitting element 71 temporarily fixed to the assembly position is fixed to the assembly position by the sensor holder 66 to be described later. The sensor holder 66 is described later in detail.

Figure 9:
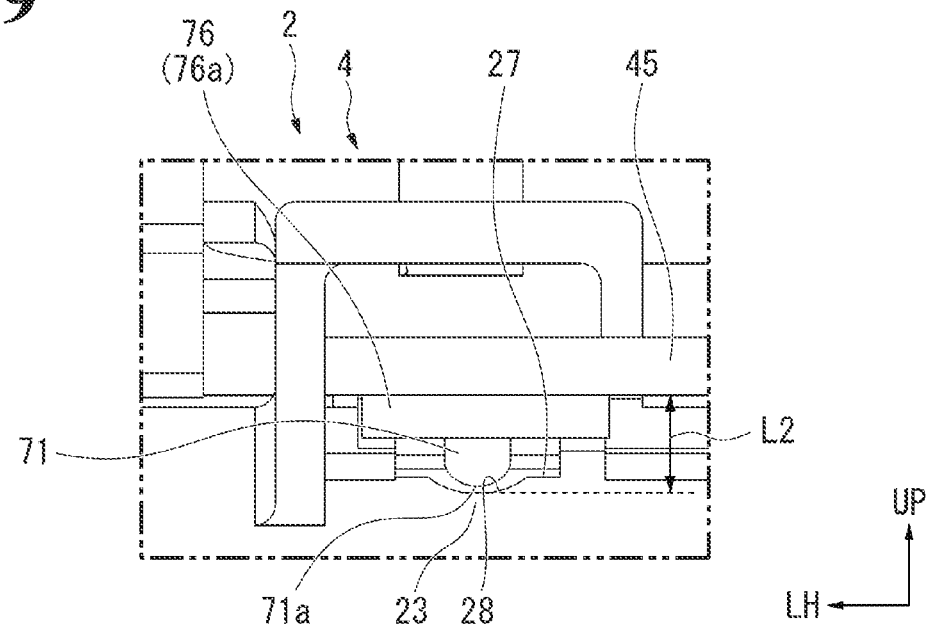
FIG. 9 is an enlarged back view for illustrating the printing unit and other components indicated by the rectangle IX of FIG. 8.

As illustrated in FIG. 7 and FIG. 9, the recessed portion 28 is formed into a curved surface (bent surface) larger than a curved surface (hereinafter, also referred to as a distal-end curved surface) of the distal end portion 71*a* of the light emitting element 71. With this configuration, the second distance L2 between the support shaft 45 and the recessed portion 28 is increased so as to allow passage of the light emitting element 71. Further, when the recessed portion 28 is formed into the curved surface, for example, stress concentration caused on the recessed portion 28 can be suppressed as compared to a case in which the recessed portion 28 is formed into, for example, a rectangular shape. Thus, strength of the casing 2 can be ensured, and, for example, drop impact resistance of the thermal printer 1 (see FIG. 1) can be ensured.

Moreover, the recessed portion 28 has a triangular shape, for example, in plan view. Accordingly, for example, as compared to a case in which the recessed portion 28 has a rectangular shape in plan view, a recess area of the recessed portion 28 can be reduced. Thus, strength of the casing 2 can be ensured, and, for example, drop impact resistance of the thermal printer 1 can be ensured.

As illustrated in FIG. 4 and FIG. 5, the light receiving element 72 is supported on the cover 3. Under a state in which the cover 3 is closed, the light receiving element 72 is arranged so as to face the light emitting element 71. The light emitting element 71 and the light receiving element 72 are connected to the control unit and other components (not shown) through, for example, the sensor flexible board 76.

Figure 10:
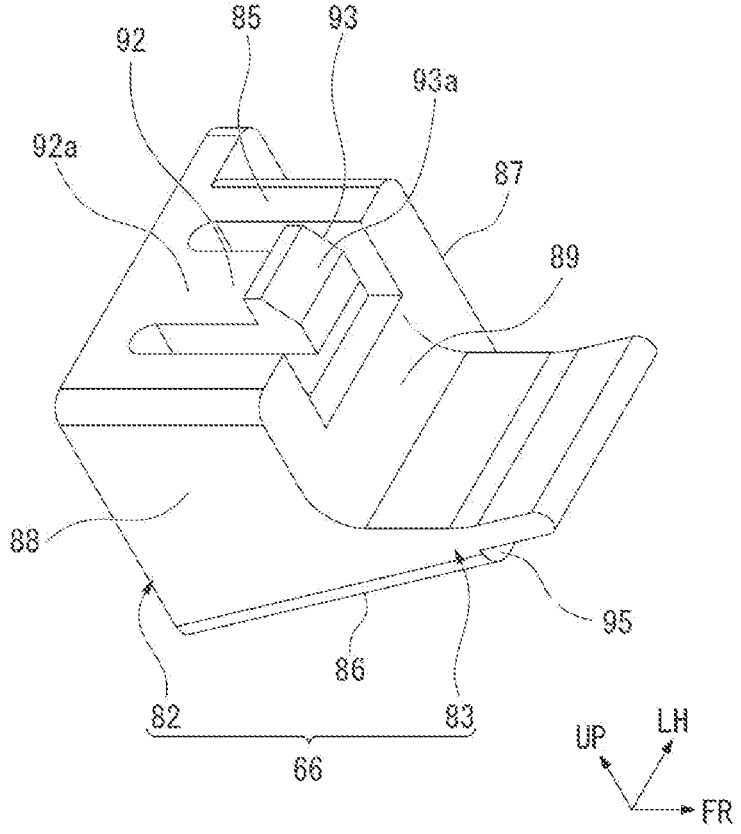
FIG. 10 is a perspective view for illustrating a sensor holder of the thermal printer according to the embodiment.

As illustrated in FIG. 5 and FIG. 10, the sensor holder 66 is locked between the guide plate 22 and a locking portion 81. The locking portion 81 is formed on a portion of the casing 2 that is located above the guide plate 22 and behind the support shaft 45. The sensor holder 66 is made of a resin material such as polycarbonate. The sensor holder 66 includes a holder base 82 and a holder protruding portion 83.

The holder base 82 includes an upper surface portion 85, a lower surface portion 86, a left surface wall 87, a right surface wall 88, and a front surface wall 89, and is formed into a hollow rectangular shape having a rear opening plane portion. The holder base 82 is formed such that the upper surface portion 85, the lower surface portion 86, the left surface wall 87, and the right surface wall 88 can be inserted between the guide plate 22 and the locking portion 81. Under a state in which the holder base 82 is inserted between the guide plate 22 and the locking portion 81, the upper surface portion 85 is held in contact with the locking portion 81, and the lower surface portion 86 is held in contact with the guide plate 22.

The upper surface portion 85 includes a snap-fit portion 92. A base end portion 92*a* of the snap-fit portion 92 is integrally coupled to a rear end portion of the upper surface portion 85, and the snap-fit portion 92 protrudes toward the front side up to a front end portion of the upper surface portion 85. The snap-fit portion 92 includes a locking claw 93 formed at a distal end portion thereof. The locking claw 93 protrudes upward from the distal end portion. An inclined surface 93*a* is formed on a front surface of the locking claw 93 so as to be inclined upward toward the rear side. The snap-fit portion 92 is formed so as to be elastically deformable in the up-and-down direction with the base end portion 92*a* being used as a fulcrum. Under a state in which the holder base 82 is inserted between the guide plate 22 and the locking portion 81, the locking claw 93 of the snap-fit portion 92 is locked to a locking hole 81*a* of the locking portion 81. In this manner, the holder base 82 (that is, the sensor holder 66) is fixed under a state of being inserted between the guide plate 22 and the locking portion 81.

The holder protruding portion 83 is integrally formed on a front edge of the lower surface portion 86 of the holder base 82. The holder protruding portion 83 protrudes from the front edge of the lower surface portion 86 so as to be inclined upward toward the front side along the guide distal end portion 23 of the guide plate 22. The holder protruding portion 83 is formed so as to be insertable between the support shaft 45 and the recessed portion 28. Further, a stepped portion 95 is formed on a center portion of a surface of the holder protruding portion 83 in the front-and-rear direction, which is opposed to the guide distal end portion 23. The stepped portion 95 is formed so as to be capable of being brought into abutment against a base rear end portion 71*c* of an element base 71*b* of the light emitting element 71 under a state in which the holder protruding portion 83 is inserted between the support shaft 45 and the recessed portion 28.

Specifically, the locking claw 93 of the holder base 82 is locked to the locking hole 81*a* so that the holder base 82 (sensor holder 66) is fixed between the guide plate 22 and the locking portion 81. Under this state, the stepped portion 95 is brought into abutment against the base rear end portion 71*c* of the element base 71*b* of the light emitting element 71. Further, under a state in which the stepped portion 95 is held in abutment against the base rear end portion 71*c*, a base front end portion 71*d* of the element base 71*b* is held in abutment against a receiving recessed portion 29 of the casing 2. In this manner, under a state in which the locking claw 93 of the holder base 82 is locked to the locking hole 81*a*, the light emitting element 71 is fixed to the casing 2.

As described above, the snap-fit portion 92 of the sensor holder 66 is elastically deformed, and can easily be locked to the casing 2. Accordingly, the light emitting element 71 (that is, the transmissive sensor 65) can easily be fixed to the casing 2 by the sensor holder 66. Thus, ease of assembly of the light emitting element 71 (that is, the transmissive sensor 65) can further be improved.

As described above, according to the thermal printer 1 in the embodiment, as illustrated in FIG. 3 and FIG. 5, under a state in which the cover 3 is closed, the platen roller 52 is rotated, thereby conveying the recording sheet P sandwiched between the platen roller 52 and the thermal head 43. Under this state, light is radiated from the light emitting element 71 of the transmissive sensor 65 to the light receiving element 72, and the radiated light is transmitted through the recording sheet P.

When comparison is made between a case in which the light radiated from the light emitting element 71 is transmitted through only the liner 31 of the recording sheet P and a case in which the light radiated from the light emitting element 71 is transmitted through both the label 32 and the liner 31, intensity of the transmitted light changes. Through detection of the change in intensity of the light by the light receiving element 72, a position of the label 32 temporarily bonded on the recording sheet P is detected. Based on information of the detected position of the label 32, the thermal head 43 performs printing at a printing position of the label 32.

Here, the light emitting element 71 is arranged between the thermal head 43 and the support shaft 45. Accordingly, the transmissive sensor 65 is arranged in the vicinity of the thermal head 43. With this configuration, printing can be performed with high accuracy at the printing position of the label 32 detected by the transmissive sensor 65.

Figure 11:
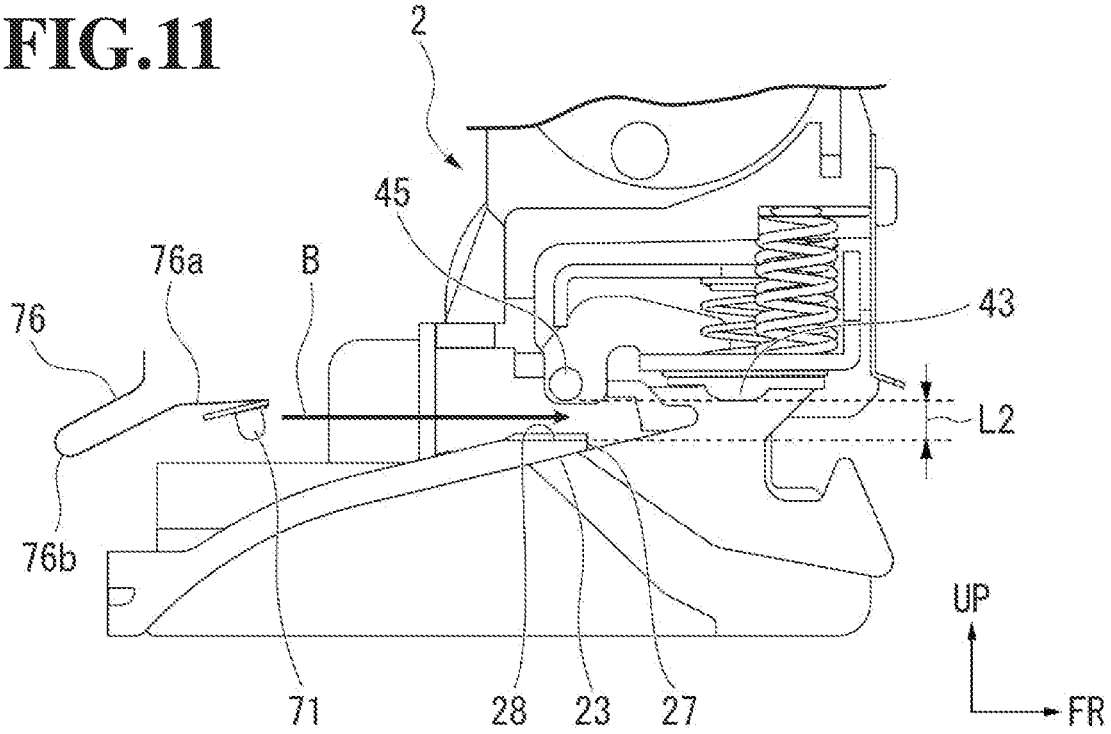
FIG. 11 is a sectional view for illustrating a sensor inserting step of inserting a light emitting element into an assembly position in the thermal printer according to the embodiment.

Next, a method of manufacturing the thermal printer 1 according to the embodiment is described with reference to FIG. 11 to FIG. 14. As illustrated in FIG. 11, in a sensor inserting step, the second distance L2 between the support shaft 45 and the guide distal end portion 23 (specifically, the recessed portion 28) is increased in the up-and-down direction because the recessed portion 28 is formed in the guide distal end portion 23. The light emitting element 71 is passed through the space having the second distance L2 increased owing to the presence of the recessed portion 28 as indicated by the arrow B of FIG. 11. The light emitting element 71 is inserted into the assembly position between the thermal head 43 and the support shaft 45 in the front-and-rear direction (that is, the position opposed to the opening portion 27).

Figure 12:
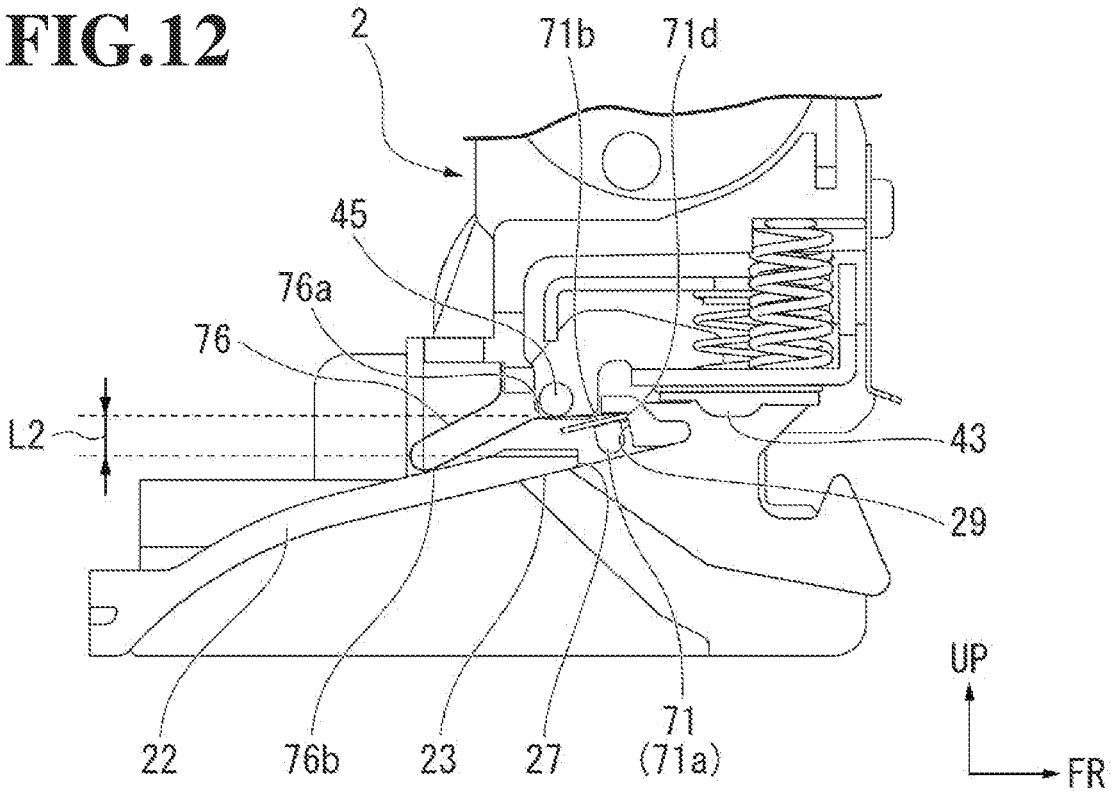
FIG. 12 is a sectional view for illustrating a sensor temporary-fixing step of temporarily fixing the light emitting element to the assembly position in the thermal printer according to the embodiment.

As illustrated in FIG. 12, in a sensor temporary-fixing step, the light emitting element 71 that has passed through the space having the second distance L2 is arranged at the assembly position between the thermal head 43 and the support shaft 45 in the front-and-rear direction. Under a state in which the light emitting element 71 is arranged at the assembly position, the base front end portion 71*d* of the element base 71*b* is brought into abutment against the receiving recessed portion 29 of the casing 2. Further, under a state in which the light emitting element 71 is arranged at the assembly position, for example, the distal end portion 76*a* of the sensor flexible board 76 is brought into abutment against the support shaft 45, and the U-shaped bent portion 76*b* of the sensor flexible board 76 is brought into abutment against the guide plate 22. Thus, for example, by the elastic force of the sensor flexible board 76 including the distal end portion 76*a*, the U-shaped bent portion 76*b*, and other components, the light emitting element 71 is temporarily fixed to the assembly position in the casing 2.

Figure 13:
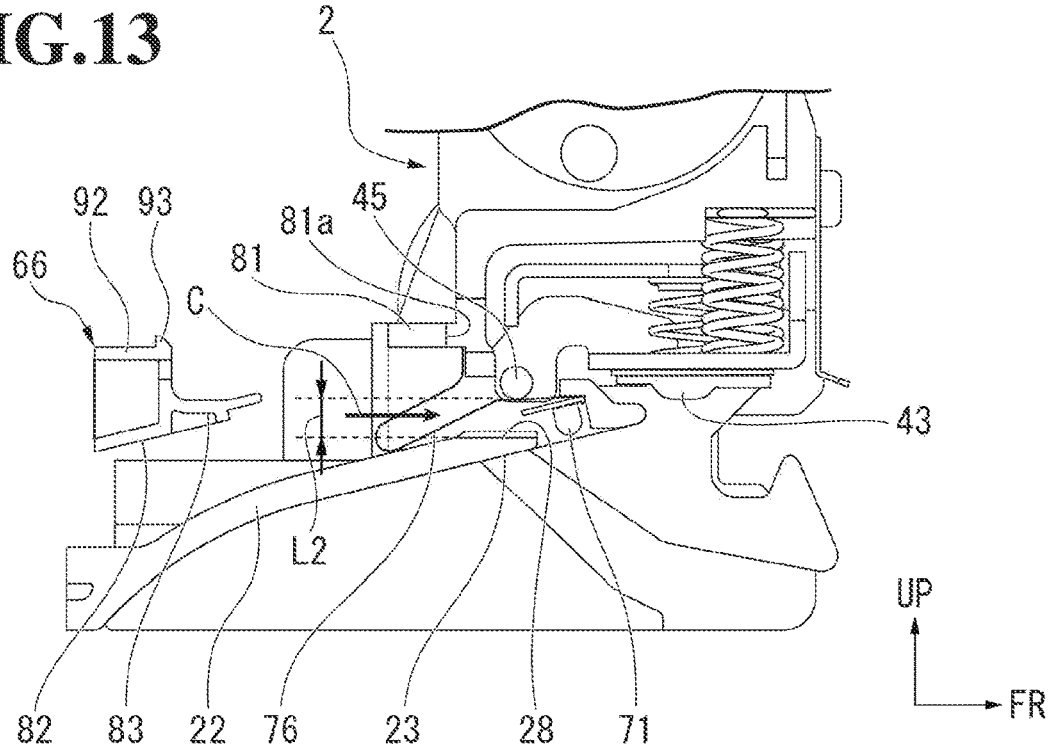
FIG. 13 is a sectional view for illustrating a sensor holder inserting step of inserting the sensor holder in the thermal printer according to the embodiment.

As illustrated in FIG. 13, in a sensor holder inserting step, after the light emitting element 71 is temporarily fixed to the assembly position in the casing 2 by the sensor flexible board 76, the sensor holder 66 is inserted between the guide plate 22 and the locking portion 81 as indicated by the arrow C of FIG. 13. Thus, the holder protruding portion 83 of the sensor holder 66 is passed through a space between the guide plate 22 and the locking portion 81, and then is inserted into the space having the second distance L2 between the support shaft 45 and the recessed portion 28 as indicated by the arrow C. At the same time, the holder base 82 of the sensor holder 66 is inserted between the guide plate 22 and the locking portion 81 as indicated by the arrow C of FIG. 13.

Figure 14:
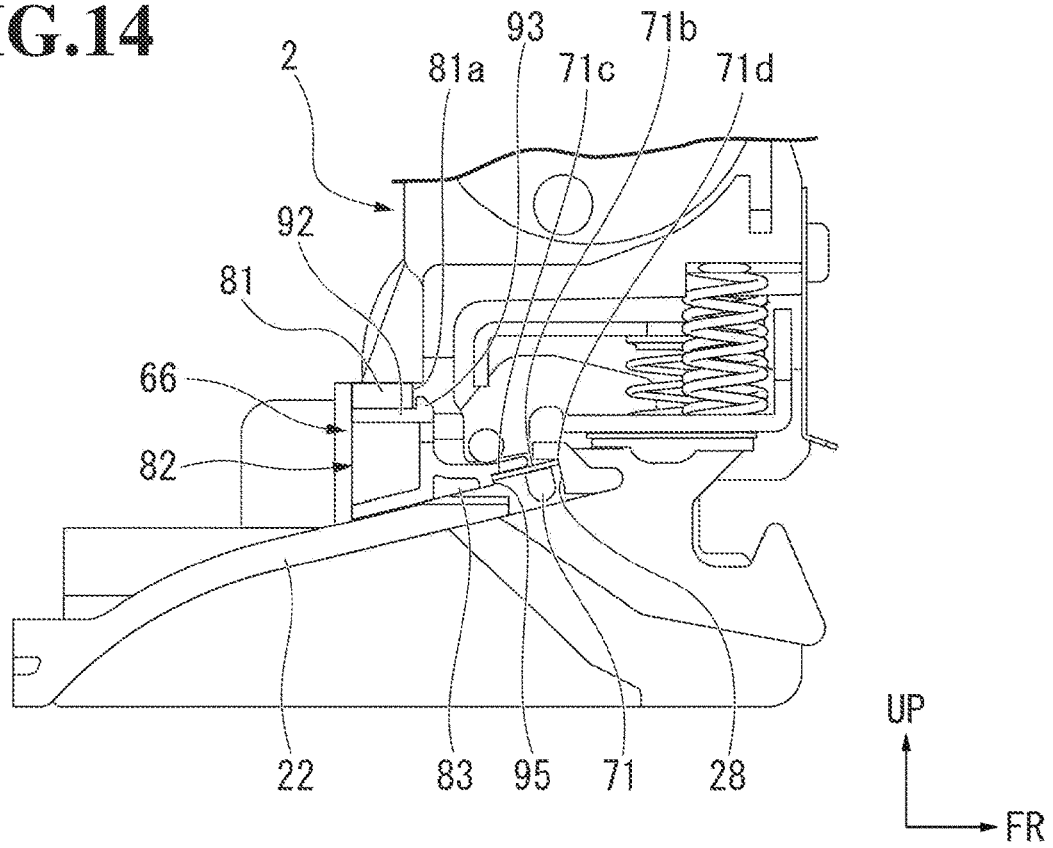
FIG. 14 is a sectional view for illustrating a sensor fixing step of fixing the temporarily-fixed light emitting element by the sensor holder in the thermal printer according to the embodiment.

As illustrated in FIG. 14, in a sensor fixing step, the holder base 82 is inserted between the guide plate 22 and the locking portion 81. At this time, the snap-fit portion 92 of the holder base 82 is elastically deformed so that the locking claw 93 of the snap-fit portion 92 is locked to the locking hole 81*a* of the locking portion 81. Thus, the holder base 82 (that is, the sensor holder 66) is fixed under a state of being inserted between the guide plate 22 and the locking portion 81. Under a state in which the sensor holder 66 is fixed, the stepped portion 95 of the holder protruding portion 83 is brought into abutment against the base rear end portion 71*c* of the element base 71*b*. Further, the base front end portion 71*d* of the element base 71*b* is held in abutment against the receiving recessed portion 29 of the casing 2. In this manner, the temporarily-fixed light emitting element 71 is fixed to the casing 2 by the sensor holder 66.

As described above, according to the method of manufacturing the thermal printer 1 according to the embodiment, the second distance L2 between the support shaft 45 and the guide distal end portion 23 (specifically, the recessed portion 28) is increased because the recessed portion 28 is formed in the guide distal end portion 23. Accordingly, the light emitting element 71 can be passed through the space having the second distance L2 increased owing to the presence of the recessed portion 28, and then can be inserted into the assembly position. Thus, without disassembling the support shaft 45 from the casing 2, the light emitting element 71 (that is, the transmissive sensor 65) can be assembled to the assembly position between the thermal head 43 and the support shaft 45 in the front-and-rear direction. Accordingly, ease of assembly of the light emitting element 71 (that is, the transmissive sensor 65) can be improved.

Further, the snap-fit portion 92 of the sensor holder 66 is elastically deformed, and thus the locking claw 93 of the snap-fit portion 92 can easily be locked to the locking hole 81*a* (that is, the casing 2). Accordingly, the light emitting element 71 can easily be fixed to the casing 2 by the sensor holder 66, and thus ease of assembly of the light emitting element 71 (that is, the transmissive sensor 65) can further be improved.

The technical scope of the present invention is not limited to the above-mentioned embodiment, but various modifications may be made without departing from the gist of the present invention.

For example, in the above-mentioned embodiment, the front-and-rear, up-and-down, and right-and-left directions of the thermal printer 1 are defined under a condition in which a user carries the thermal printer 1, but the front-and-rear, up-and-down, and right-and-left directions of the thermal printer 1 may be optionally selected in accordance with purposes.

Besides the above, the components in the above-mentioned embodiment may be replaced by well-known components as appropriate without departing from the gist of the present invention.

What is claimed is:

1. A printer, comprising:

a mechanism frame configured to receive a recording medium including a liner having a large length, and a plurality of labels temporarily bonded on the liner;

a support member supported on the mechanism frame through intermediation of a support shaft;

a head which is mounted to the support member, and is configured to perform printing on at least one of the plurality of labels; and a transmissive sensor which is arranged between the head and the support shaft, and is configured to detect the at least one of the plurality of labels, wherein the mechanism frame includes:

a frame portion provided between the head and the support shaft at a distance from the support shaft; and a recessed portion which is formed in the frame portion, and is configured to increase the distance so as to allow the transmissive sensor to pass through a space having the distance.

2. The printer according to claim 1, further comprising a sensor holder which includes a snap-fit portion that is elastically deformable and is locked to the mechanism frame, and is configured to fix the transmissive sensor to the mechanism frame through locking of the snap-fit portion to the mechanism frame.

3. The printer according to claim 1, wherein the recessed portion is formed into a curved surface larger than a distal-end curved surface of the transmissive sensor.

4. The printer according to any one of claim 1, wherein the transmissive sensor includes:

a light emitting element supported on the mechanism frame; and a light receiving element supported on a cover so as to face the light emitting element, and wherein the light emitting element is passed through the space having the distance increased owing to the presence of the recessed portion, and then is arranged between the head and the support shaft.

5. A method of manufacturing a printer, the printer comprising:

a mechanism frame configured to receive a recording medium including a liner having a large length, and a plurality of labels temporarily bonded on the liner;

a support member supported on the mechanism frame through intermediation of a support shaft;

a head which is mounted to the support member, and is configured to perform printing on at least one of the plurality of labels;

a transmissive sensor which is arranged between the head and the support shaft, and is configured to detect the at least one of the plurality of labels; and a sensor holder including a snap-fit portion that is elastically deformed and lockable to the mechanism frame in order to fix the transmissive sensor to the mechanism frame, the mechanism frame including:

a frame portion provided between the head and the support shaft at a distance from the support shaft; and a recessed portion which is formed in the frame portion, and is configured to increase the distance so as to allow the transmissive sensor to pass through a space having the distance, the method comprising:

a sensor inserting step of passing the transmissive sensor through the space having the distance increased owing to the presence of the recessed portion, and then inserting the transmissive sensor between the head and the support shaft;

a sensor temporary-fixing step of temporarily fixing the transmissive sensor, which is inserted between the head and the support shaft, to the mechanism frame;

a sensor holder inserting step of inserting the sensor holder into the space having the distance; and a sensor fixing step of elastically deforming the snap-fit portion of the sensor holder, and locking the snap-fit portion to the mechanism frame, thereby fixing the temporarily-fixed transmissive sensor to the mechanism frame by the sensor holder.

* * * * *